US005838243A

United States Patent [19]

Gallo

[11] Patent Number: 5,838,243

[45] Date of Patent: Nov. 17, 1998

[54] COMBINATION CARBON MONOXIDE SENSOR AND COMBUSTION HEATING DEVICE SHUT-OFF SYSTEM

[76] Inventor: Eugene Gallo, 5 Judge St., Brooklyn, N.Y. 11211

[21] Appl. No.: 833,905

[22] Filed: Apr. 10, 1997

[51] Int. Cl.[6] ..... G08B 17/10

[52] U.S. Cl. ..... 340/632; 340/522; 340/634; 340/693; 73/31.02; 236/21 R

[58] Field of Search ..... 340/632, 633, 340/634, 825.06, 522, 500, 501, 691, 693; 73/23.2, 31.01, 31.02, 31.03, 23.34, 23.32, 31.05, 31.06; 432/37, 36; 200/61.03; 422/94, 98, 88; 204/425; 338/34, 35; 236/21 R; 431/18, 51, 16; 110/185

[56] References Cited

U.S. PATENT DOCUMENTS

| | | | |
|---|---|---|---|
| D. 350,300 | 9/1994 | Browning et al. | D10/106 |
| 4,069,018 | 1/1978 | Karna et al. | 340/579 |
| 4,088,986 | 5/1978 | Boucher | 340/521 |
| 4,526,028 | 7/1985 | Hubner | 340/632 |
| 4,893,113 | 1/1990 | Park et al. | 340/632 |
| 4,930,488 | 6/1990 | Pearman et al. | 126/39 E |
| 5,066,466 | 11/1991 | Holter et al. | 422/98 |
| 5,276,434 | 1/1994 | Brooks et al. | 340/632 |
| 5,333,703 | 8/1994 | James et al. | 180/271 |
| 5,576,739 | 11/1996 | Murphy | 340/825.06 |

*Primary Examiner*—Nina Tong

[57] ABSTRACT

A new Combination Carbon Monoxide Sensor and Furnace Shut-Off System for automatically terminating natural gas flow to a malfunctioning boiler or furnace which is producing dangerous levels of carbon monoxide. The inventive device includes a carbon monoxide sensor system for detecting carbon monoxide, and a control valve electrically connected to the carbon monoxide sensor system and connected within a gas pipe for controlling the flow of natural gas within the gas pipe. When the carbon monoxide sensor system detects a dangerous level of carbon monoxide surrounding the boiler or furnace, a solenoid is electrically activated for closing the control valve for stopping the flow of natural gas into the malfunctioning boiler or furnace.

6 Claims, 3 Drawing Sheets

COMBINATION CARBON MONOXIDE SENSOR AND COMBUSTION HEATING DEVICE SHUT-OFF SYSTEM

BACKGROUND OF THE INVENTION

1. Field of the Invention

The present invention relates to Carbon Monoxide Safety Devices and more particularly pertains to a new Combination Carbon Monoxide Sensor and Furnace Shut-Off System for automatically terminating natural gas flow to a malfunctioning boiler or furnace which is producing dangerous levels of carbon monoxide.

2. Description of the Prior Art

The use of Carbon Monoxide Safety Devices is known in the prior art. More specifically, Carbon Monoxide Safety Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Carbon Monoxide Safety Devices include U.S. Pat. No. 5,066,466; U.S. Pat. No. 4,893,113; U.S. Design Pat. No. 350,300; U.S. Pat. No. 4,088,986; U.S. Pat. No. 4,069,018 and U.S. Pat. No. 5,333,703.

While these devices fulfill their respective, particular objectives and requirements, the aforementioned patents do not disclose a new Combination Carbon Monoxide Sensor and Furnace Shut-Off System. The inventive device includes a carbon monoxide sensor system for detecting carbon monoxide, and a control valve electrically connected to the carbon monoxide sensor system and connected within a gas pipe for controlling the flow of natural gas within the gas pipe.

In these respects, the Combination Carbon Monoxide Sensor and Furnace Shut-Off System according to the present invention substantially departs from the conventional concepts and designs of the prior art, and in so doing provides an apparatus primarily developed for the purpose of automatically terminating natural gas flow to a malfunctioning boiler or furnace which is producing dangerous levels of carbon monoxide.

SUMMARY OF THE INVENTION

In view of the foregoing disadvantages inherent in the known types of Carbon Monoxide Safety Devices now present in the prior art, the present invention provides a new Combination Carbon Monoxide Sensor and Furnace Shut-Off System construction wherein the same can be utilized for automatically terminating natural gas flow to a malfunctioning boiler or furnace which is producing dangerous levels of carbon monoxide.

The general purpose of the present invention, which will be described subsequently in greater detail, is to provide a new Combination Carbon Monoxide Sensor and Furnace Shut-Off System apparatus and method which has many of the advantages of the Carbon Monoxide Safety Devices mentioned heretofore and many novel features that result in a new Combination Carbon Monoxide Sensor and Furnace Shut-Off System which is not anticipated, rendered obvious, suggested, or even implied by any of the prior art Carbon Monoxide Safety Devices, either alone or in any combination thereof.

To attain this, the present invention generally comprises a carbon monoxide sensor system for detecting carbon monoxide, and a control valve electrically connected to the carbon monoxide sensor system and connected within a gas pipe for controlling the flow of natural gas within the gas pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Combination Carbon Monoxide Sensor and Furnace Shut-Off System apparatus and method which has many of the advantages of the Carbon Monoxide Safety Devices mentioned heretofore and many novel features that result in a new Combination Carbon Monoxide Sensor and Furnace Shut-Off System which is not anticipated, rendered obvious, suggested, or even implied by any of the prior art Carbon Monoxide Safety Devices, either alone or in any combination thereof.

It is another object of the present invention to provide a new Combination Carbon Monoxide Sensor and Furnace Shut-Off System which may be easily and efficiently manufactured and marketed.

It is a further object of the present invention to provide a new Combination Carbon Monoxide Sensor and Furnace Shut-Off System which is of a durable and reliable construction.

An even further object of the present invention is to provide a new Combination Carbon Monoxide Sensor and Furnace Shut-Off System which is susceptible of a low cost of manufacture with regard to both materials and labor, and which accordingly is then susceptible of low prices of sale to the consuming public, thereby making such Combination Carbon Monoxide Sensor and Furnace Shut-Off System economically available to the buying public.

Still yet another object of the present invention is to provide a new Combination Carbon Monoxide Sensor and Furnace Shut-Off System which provides in the apparatuses and methods of the prior art some of the advantages thereof, while simultaneously overcoming some of the disadvantages normally associated therewith.

Still another object of the present invention is to provide a new Combination Carbon Monoxide Sensor and Furnace Shut-Off System for automatically terminating natural gas flow to a malfunctioning boiler or furnace which is producing dangerous levels of carbon monoxide.

Yet another object of the present invention is to provide a new Combination Carbon Monoxide Sensor and Furnace Shut-Off System which includes a carbon monoxide sensor system for detecting carbon monoxide, and a control valve electrically connected to the carbon monoxide sensor system and connected within a gas pipe for controlling the flow of natural gas within the gas pipe.

Still yet another object of the present invention is to provide a new Combination Carbon Monoxide Sensor and Furnace Shut-Off System that saves lives by preventing carbon monoxide inhalation.

Even still another object of the present invention is to provide a new Combination Carbon Monoxide Sensor and Furnace Shut-Off System that automatically shuts down a malfunctioning boiler or furnace utilizing natural gas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
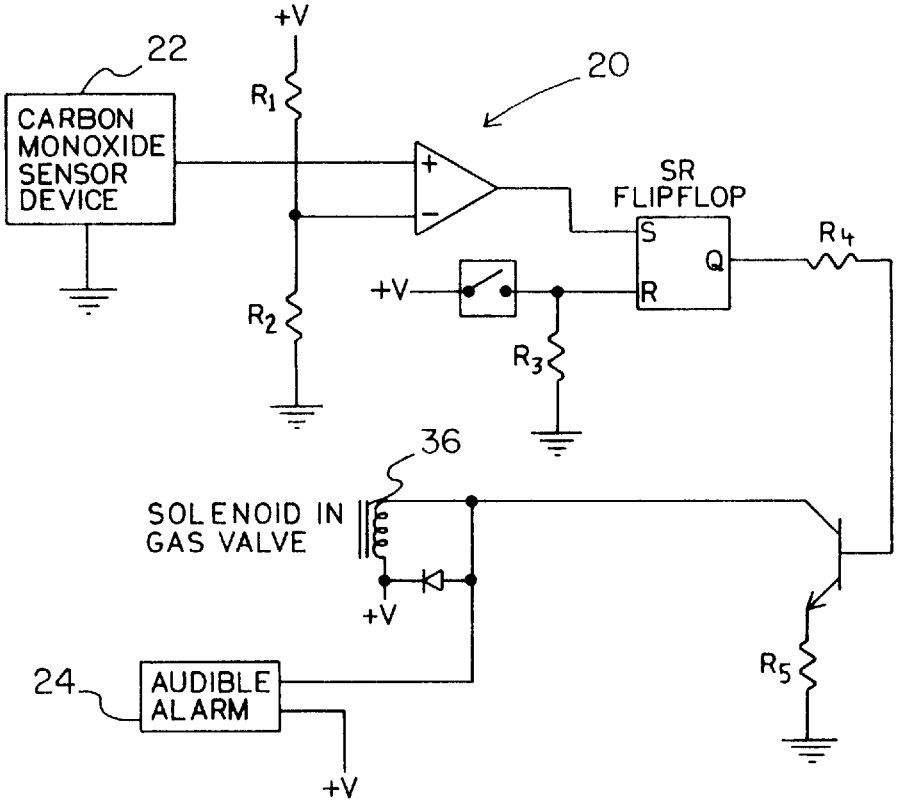
FIG. 1 is a schematic diagram of a conventional circuitry forming the carbon monoxide sensor system.

With reference now to the drawings, and in particular to FIGS. 1 through 4 thereof, a new Combination Carbon Monoxide Sensor and Furnace Shut-Off System embodying the principles and concepts of the present invention and generally designated by the reference numeral 10 will be described.

Figure 2:
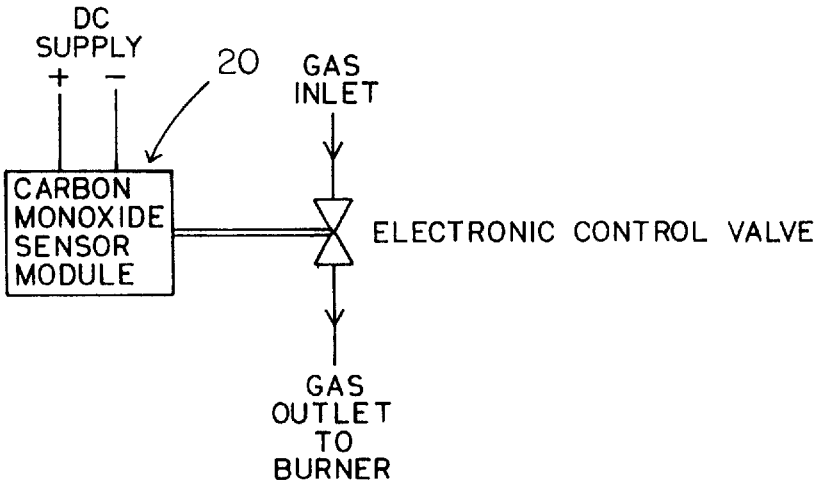
FIG. 2 is a schematic illustration of the present invention connected to a gas pipe.

More specifically, it will be noted that the Combination Carbon Monoxide Sensor and Furnace Shut-Off System 10 comprises a control valve 30 electrically connected to a carbon monoxide sensor system 20 as best shown in FIG. 2 of the drawings. The carbon monoxide sensor system 20 comprises a conventional circuiter known in the prior art as shown in FIG. 1 of the drawings.

As best shown in FIG. 2 of the drawings, the control valve 30 connected within a gas pipe 12 leading to a heating device such as a boiler 14 or a unnumbered furnace. The control valve 30 controls the flow of natural gas to the heating device as shown in FIG. 2 of the drawings. The control valve 30 includes a solenoid 36 electrically connected to the carbon monoxide sensor system 20 as shown in FIG. 1 of the drawings. The solenoid 36 is electrically connected to the carbon monoxide sensor system 20 by an insulated wire 34, wherein the insulated wire 34 includes heat resistant insulation for preventing deterioration of the insulated wire 34. The control valve 30 includes a pair of pipe couplers 32 connected opposite of one another for coupling within the gas pipe 12 as best shown in FIG. 2.

As shown in FIG. 2 of the drawings, the carbon monoxide sensor system 20 is electrically connected to the control valve 30 for controlling the control valve 30. Upon detecting a dangerous level of carbon monoxide, the carbon monoxide sensor system 20 closes the control valve 30 for stopping the flow of natural gas to the heating device thereby preventing further carbon monoxide contamination of the air within a building.

Figure 3:
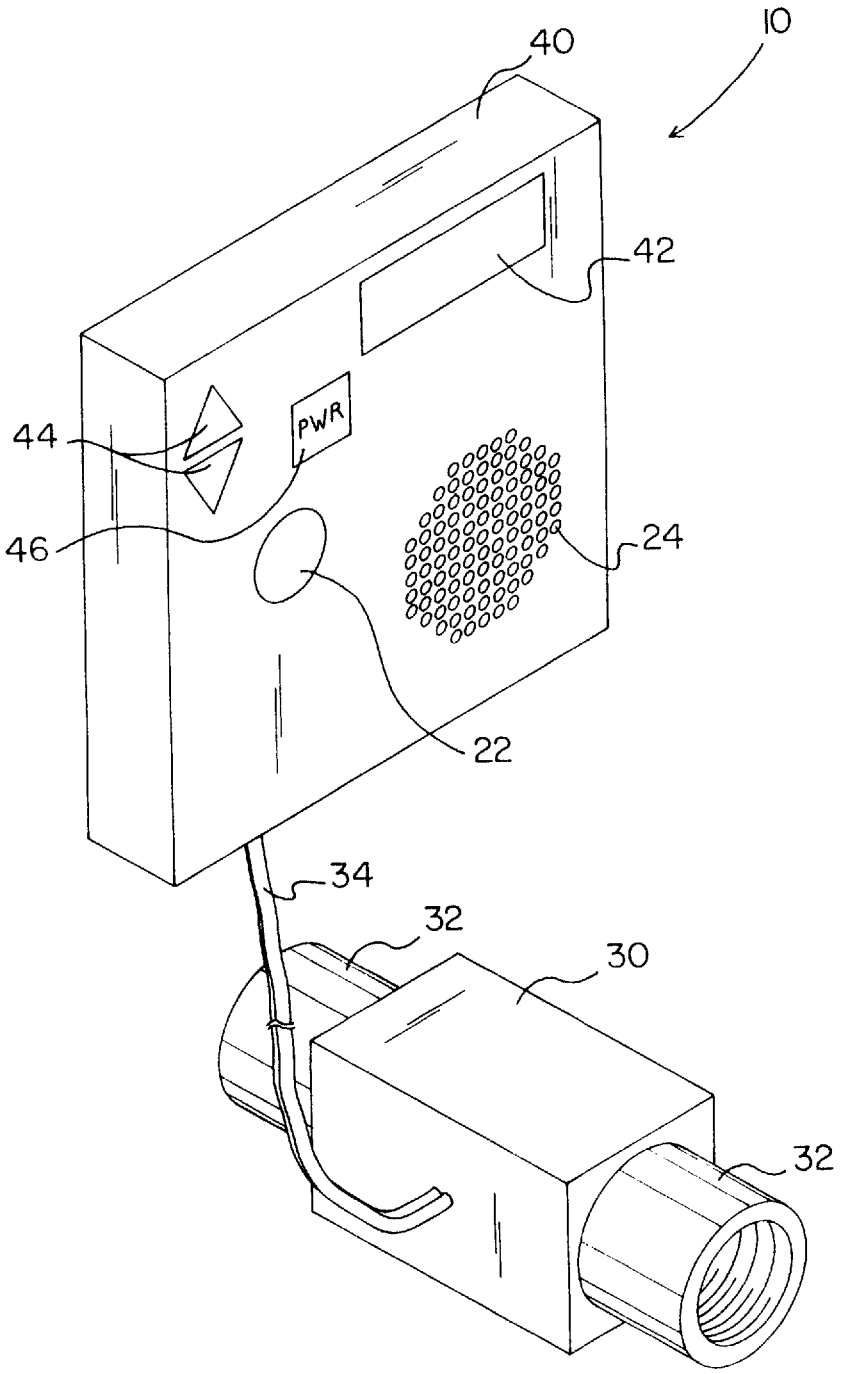
FIG. 3 is an upper perspective view of the present invention.
Figure 4:
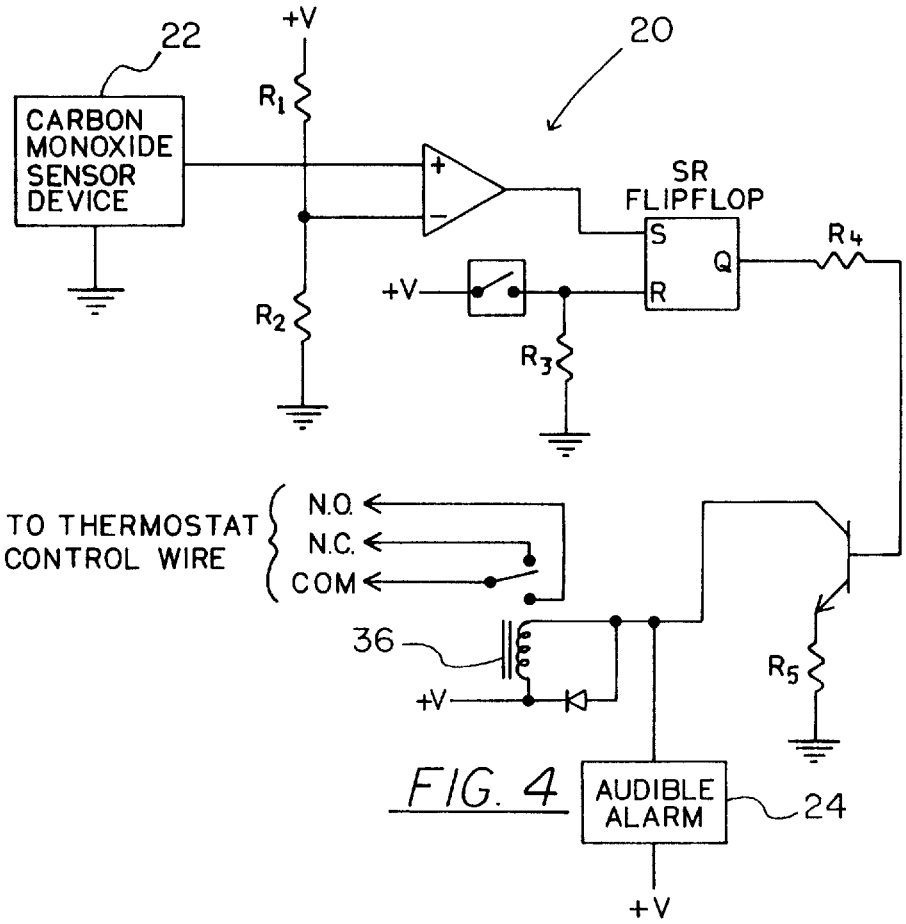
FIG. 4 is a schematic illustration of an alternative embodiment of the present invention.

As shown in FIGS. 3 and 4 of the drawings, a housing 40 encloses the carbon monoxide sensor system 20. A display 42 is positioned within the housing 40 for displaying relevant information regarding current carbon monoxide levels within the building or the sensitivity of carbon monoxide sensor system 20. The carbon monoxide sensor system 20 includes a sensor device 22 for detecting various levels of carbon monoxide as shown in FIGS. 1 and 4 of the drawings. An audible alarm device 24 is electrically connected within the carbon monoxide sensor system 20 for emitting an audible alarm in an event a dangerous level of carbon monoxide is detected by the sensor device 22. A power switch 46 is secured within the housing 40 and is electrically connected to the carbon monoxide sensor system 20 for controlling power to the carbon monoxide sensor system 20. A pair of sensitivity switches 44 are secured within the housing 40 for allowing manual adjustment of a sensitivity of the carbon monoxide sensor system 20 whereby the sensitivity is shown upon the display 42 as best shown in FIG. 4 of the drawings.

In use, the carbon monoxide sensor system 20 constantly monitors the level of carbon monoxide near the heating device. Upon detecting a dangerous level of carbon monoxide, the solenoid 36 and the audible alarm device 24 are activated thereby warning occupants within the building and terminating gas flow to the heating device. The solenoid 36 closes the control valve 30 to prevent the flow of natural gas into the heating device. The present invention does not allow the flow of natural gas into the heating device until a user resets the present invention by opening the power switch 46 and then closing the power switch 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination carbon monoxide sensor and combustion heating device shut-off system kit for control of carbon monoxide danger, said kit comprising:

a control valve connected in a gas pipe supplying gas to a combustion heating device employing a flame to burn gas, wherein said control valve controls a flow of gas to said combustion heating device; and a carbon monoxide detecting means for detecting carbon monoxide levels in an air space, said carbon monoxide detecting means being electrically connected to said control valve for controlling the closing of said control valve, said carbon monoxide detecting means being adapted to close said control valve for stopping said flow of gas to said heating device upon detection by said detecting means of the presence of a pre-determined level of carbon monoxide, said carbon monoxide detecting means being adapted to sound an audible alarm upon detection by said detecting means of the presence of a pre-determined level of carbon monoxide.

2. A combination carbon monoxide sensor and combustion heating device shut-off system kit for control of carbon monoxide danger, said kit comprising:

a control valve connected in a gas pipe supplying gas to a combustion heating device employing a flame to burn gas, wherein said control valve controls a flow of gas to said combustion heating device;

a carbon monoxide detecting means for detecting carbon monoxide levels in an air space, said carbon monoxide detecting means being electrically connected to said control valve for controlling said control valve, said carbon monoxide detecting means being adapted to close said control valve for stopping said flow of gas to said combustion heating device upon detection by said detecting means of the presence of a pre-determined level of carbon monoxide; and wherein said carbon monoxide detecting means comprises a housing;

a display within said housing;

a carbon monoxide sensor system within said housing, wherein said carbon monoxide sensor system includes a sensor device for detecting various levels of carbon monoxide and an audible alarm device for emitting an audible alarm in an event a pre-determined level of carbon monoxide is detected;

a power switch secured within said housing and electrically connected to said carbon monoxide sensor system for controlling power to said carbon monoxide sensor system; and a pair of sensitivity switches secured within said housing for allowing manual adjustment of a sensitivity of said carbon monoxide sensor system whereby said sensitivity is shown upon said display.

3. The combination carbon monoxide sensor and furnace shut-off system of claim 2, wherein said control valve includes a solenoid electrically connected to said carbon monoxide sensor device in a manner such that an electrical signal from said detecting means causes said solenoid to close said control valve.

4. The combination carbon monoxide sensor and furnace shut-off system of claim 3, wherein said control valve includes a pair of pipe couplers connected opposite of one another for coupling within said gas pipe.

5. The combination carbon monoxide sensor and furnace shut-off system of claim 4, wherein said solenoid is electrically connected to said carbon monoxide sensor system by an insulated wire, wherein said insulated wire includes heat resistant insulation.

6. In combination, a combustion heating device employing a flame to burn gas supplied to said heating device by a pipe:

a thermostat adapted to control operation of said combustion heating device to regulate the air temperature of a space; and a carbon monoxide sensor and combustion heating device shut-off system for control of carbon monoxide danger from said combustion heating device;

said shut-off system comprising a carbon monoxide detecting means for detecting carbon monoxide levels in an air space, said carbon monoxide detecting means being positioned near said combustion heating device, said detecting means comprising a carbon monoxide sensor system positioned in a housing, said carbon monoxide sensor system including a sensor device for detecting various levels of carbon monoxide in the air near the combustion heating device and an audible alarm device for emitting an audible alarm in an event a pre-determined level of carbon monoxide is detected, a power switch positioned in said housing and electrically connected to said carbon monoxide sensor system for controlling power to said carbon monoxide sensor system and a pair of sensitivity switches secured within said housing for allowing manual adjustment of a sensitivity of said carbon monoxide sensor system, wherein said carbon monoxide detecting means is electrically connected to said thermostat of said combustion heating device, said sensor device being electrically connected to said thermostat in a manner such that an electrical signal from said sensor device causes said thermostat to stop the burning of gas by said combustion heating device upon detection of a predetermined carbon monoxide level to thereby stop generation of carbon monoxide by said combustion heating device.

* * * * *